US011359165B2

(12) United States Patent
Friedli

(10) Patent No.: US 11,359,165 B2
(45) Date of Patent: Jun. 14, 2022

(54) LAUNDRY SPOT REMOVER

(71) Applicant: Floyd E. Friedli, Dublin, OH (US)

(72) Inventor: Floyd E. Friedli, Dublin, OH (US)

( * ) Notice: Subject to any disclaimer, the term of this patent is extended or adjusted under 35 U.S.C. 154(b) by 2 days.

(21) Appl. No.: 17/149,994

(22) Filed: Jan. 15, 2021

(65) Prior Publication Data

US 2021/0214650 A1 Jul. 15, 2021

Related U.S. Application Data

(60) Provisional application No. 62/961,449, filed on Jan. 15, 2020.

(51) Int. Cl.

| | |
|---|---|
| ***C11D 17/00*** | (2006.01) |
| ***C11D 1/29*** | (2006.01) |
| ***C11D 1/44*** | (2006.01) |
| ***C11D 1/72*** | (2006.01) |
| ***C11D 1/83*** | (2006.01) |
| ***C11D 3/37*** | (2006.01) |
| ***C11D 3/43*** | (2006.01) |
| ***C11D 11/00*** | (2006.01) |
| *C11D 1/14* | (2006.01) |

(52) U.S. Cl.

CPC ..... *C11D 1/83* (2013.01); *C11D 3/3765* (2013.01); *C11D 3/43* (2013.01); *C11D 11/0017* (2013.01); *C11D 11/0023* (2013.01); *C11D 1/146* (2013.01); *C11D 1/72* (2013.01)

(58) Field of Classification Search

None

See application file for complete search history.

(56) References Cited

U.S. PATENT DOCUMENTS

| | | | | |
|---|---|---|---|---|
| 4,116,851 | A * | 9/1978 | Rupe | C11D 3/18 510/237 |
| 6,022,841 | A * | 2/2000 | Lu | C11D 1/8355 510/505 |
| 6,048,368 | A * | 4/2000 | Tcheou | C11D 11/0017 510/342 |
| 6,228,830 | B1 * | 5/2001 | Vlasblom | C11D 1/86 510/432 |
| 6,376,446 | B1 * | 4/2002 | Smadi | C11D 3/30 510/342 |
| 7,985,725 | B2 * | 7/2011 | Tippetts | C11D 3/2068 510/424 |
| 2006/0241010 | A1 * | 10/2006 | Boone | C11D 3/2086 510/488 |
| 2012/0071384 | A1 * | 3/2012 | Christensen | C11D 3/43 510/335 |

* cited by examiner

*Primary Examiner* — Lorna M Douyon

(74) *Attorney, Agent, or Firm* — Mueller Law, LLC; Jerry K. Mueller, Jr.

(57) ABSTRACT

A cleaning formulation is formulated from an ethoxylated alcohol or nonionic at 15-50%, an ethoxylated amine at 10-50%, an anionic at 5-50%, a non-water soluble solvent at 0.5-15%, a water and organic soluble solvent at 1-25%, an optional acrylate based polymer, optional dyes and perfumes, and the remainder water.

6 Claims, No Drawings

LAUNDRY SPOT REMOVER

CROSS-REFERENCE TO RELATED APPLICATIONS

This application claims benefit of provisional 62/961,449 filed Jan. 15, 2020.

STATEMENT REGARDING FEDERALLY SPONSORED RESEARCH AND DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM

Not applicable.

STATEMENT REGARDING PRIOR DISCLOSURES BY THE INVENTOR OR A JOINT INVENTOR

Not applicable.

BACKGROUND OF THE INVENTION

Thousands of detergent and cleaning formulations have been developed over the years most containing anionic ingredients for particulate removal, nonionic ingredients for grease removal, builders to raise the pH and control water hardness, solvents, perfume, dyes, and other minor ingredients. A crude blend of ingredients is revealed in *INFORM* June 2016, Vol. 27 (6), pages 10-13. The invention is an expansion of this earlier concept.

BRIEF SUMMARY OF THE INVENTION

A stain removal for clothes was developed that is best used as a "pre-spotter" prior to doing the laundry. It also can be used on carpets and some hard surfaces. The stain or spot remover is effective on a wide variety of stains, but is particularly effective on greasy soils. The invention is a unique blend of surfactants and solvents with the key ingredient being an ethoxylated amine.

BRIEF DESCRIPTION OF THE SEVERAL VIEWS OF THE DRAWINGS

None.

DETAILED DESCRIPTION OF THE INVENTION

This invention comprises a blend of a grease cutting nonionic (15-50%), an anionic (preferably a 3-mole ether sulfate at 5-50% concentration), an ethoxylated amine (like cocoamine reacted with 5 moles of ethylene oxide [EO]), a non-water soluble solvent to aid in grease cutting, a water and oil soluble solvent (0-25%) to aid in solubilizing all the ingredients, a perfume, water, and possibly an anti-redeposition polymer. Table 1 lists preferred ingredients, amounts, and typical brand names.

TABLE 1

| Ingredient | Amount (wt-%) | Source |
|---|---|---|
| $C_{9-11}$ ethoxylated alcohols | 15-50 | Stepan Biosoft N91-6 |
| Alkyl ($C_{10-16}$) ether sulfate sodium salt | 5-50 | Stepan Steol CS-330 |
| Coco alkyl ethoxylated amines | 10-50 | Evonik Varonic K205 |
| d-limonene | 0.5-15 | |
| Hexylene glycol | 0-25 | |
| Water | 10-50 | |
| Acrylate-styrene polymer | 0-5 | Akzo Nobel Alcosperse 747 |

Grease cutting nonionic ingredients are not the typical laundry nonionic ingredients, such as, for example $C_{12-15}$ alcohols with 9 EO (ethoxylate) groups. This invention uses shorter chain alcohols with less EO groups, and possibly branching in the alkyl chain. $C_{9-11}$ alcohols with 6 EO groups or 3-propylheptanol with 5 EO groups are suitable according to the present disclosure and as reduced to practice in the working examples. A variety of anionic ingredients can be used in the invention for particulate removal, such as, for example, sodium dodecylbenzene sulfonate. Ether sulfates with 3 EO groups are preferred for ease of formulation, cleaning power, rapid biodegradation, and good performance in both hard and soft water.

Ethoxylated (or propoxylated) amines mostly are used as industrial emulsifiers in industries such as for agricultural chemicals. Their use in laundry products is unknown (Marcel Dekker Surfactant Series Vol. 98, *Detergency of Specialty Surfactants*, Chapter 2). Chemically, ethoxylated amines are similar to traditional carbon-hydrogen-oxygen nonionic ingredients in basic properties. They dissolve or emulsify grease very well. Ethoxylated amines, however, coat surfaces readily so they go to stains and wet them. Preferred structures are cocoamine plus 5 moles of EO and tallow amine+10 moles of EO. Molecules containing nitrogen typically also impart dye transfer inhibition properties to the fabric so that colors don't bleed in the washing process. Structure #1 represents most, but not all, types of the ethoxylated amine.

Structure #1

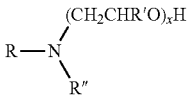

Where, R=alkyl chain or ether alkyl chain;

i. R'=H or methyl;

ii. R"=methyl, ethyl, or $(CH_2CHR'O)_xH$; and iii. x+y=2-20.

An organic solvent such as d-limonene is known to dissolve grease and is a common cleaning additive for all types of laundry, hard surface, and difficult industrial cleaning. Orange oil, kerosene, C-15 olefins (Myralene 10™), and xylene are other good materials. D-limonene is the preferred material, because it has a pleasant citrus odor and can also serve as the perfume ingredient without needing an additional ingredient.

A hydrotrope or compatibilizing solvent is needed to make the mixture homogeneous. The preferred material is hexylene glycol because of its formulation properties and non-flammability. Other solvents that are both organic and water soluble, such as, ethanol, isopropanol, propylene glycol, and ethylene glycol also can be used.

Anti-redeposition polymers, such as, for example, low molecular weight polyacylates and co-polymers of acrylic acid-styrene are acceptable optional ingredients to improve the formulation and help with water hardness.

The inventive formula is effective in removing all types of grease. It is ideal for stains from kitchen grease/oil, automotive grease/oil, spaghetti, chocolate, ring around the collar, ink, grass stain and general food. The formula is less effective on wine, coffee, and tea, which are best treated with hydrogen peroxide. It is also not very useful for removing blood, which should be rinsed heavily with cold water.

Examples

Formulation A—Concentrated Version 46 grams cocoamine+5 EO (Varonic K205) were added to a beaker on a stirring hot plate followed by the addition of 46 grams $C_{9-11}$ alcohols+6 EO (Biosoft N91-6), 4 grams acrylate-styrene polymer (Alcosperse 747 as is 50% in water), 10 grams d-limonene, and 12 grams hexylene glycol. The mixture was clear with a thin viscosity. Then, 48 grams of ether sulfate (Steol CS-330 as is at 30% active) was added slowly with increased heat and stirring. The mixture was cloudy, but not too thick at 32° C. Finally, 34 grams of water was added with continued stirring and heat. The resulting formulation when cooled to room temperature was slightly cloudy with a Maple syrup viscosity; ideal for testing as a pre-spotter for laundry stains.

Repeated preparations of this formula occasionally resulting in thickening and clump formation mid-batch. These required more vigorous agitation and heating to end up with the expected uniform slightly thick formula. A more consistent preparation was needed for predictable manufacturing.

Formulation B—2 Part Preparation of Concentrated Version

Organic Portion: To a 1-liter beaker with stirring was added 230 g Evonik Varonic K205 coco alkyl ethoxylated amines, 230 g 91-6, 50 g d-limonene, and 60 grams hexylene glycol at room temperature. The resulting mixture was slightly cloudy, uniform, with no clumps.

Water Portion: To a 1-liter beaker with stirring was added 19 grams water, 230 grams ether sulfate, and 10 g Akzo Nobel Alcosperse acrylate-styrene polymer. This portion was clear, uniform and contained no clumps.

The Water Portion then was added slowly to the Organic Portion with moderate stirring and slight heating. Each addition resulting in "swirls", but they cleared up quickly with the stirring resulting in a final formulation that was almost clear, uniform, free of clumps with a slightly thick viscosity suitable for a direct application cleaner.

Formulation C—Spray Version

To a 1-liter beaker with stirring and heated was added 100 g Formulation B. Under moderate stirring at slightly above room temperature was slowly added 100 g water. Some "swirls" were generated, but quickly disappeared with stirring. Formulation C was clear, uniform, free of lumps, and had a viscosity slightly higher than water. The material was placed into a commercial spray bottle suitable for a cleaner and provided a good spray with no clogging.

Application Testing—Comparative Test Results

| Example Test 1[a] (%) | | | | |
|---|---|---|---|---|
| Stain Type | Consumer Spot Remover #1 | Consumer Spot Remover #2 | Popular Detergent | Inventive Spot Remover |
| Chocolate | 60 | 80 | 95 | 90 |
| Spaghetti | 80 | 80 | 80 | 90 |
| Spinach-pear baby food | 98 | 98 | 98 | 98 |
| Automotive grease | 75 | 90 | 60 | 75 |
| Kitchen grease | 95 | 95 | 90 | 95 |
| TOTAL REMOVAL | 408 | 443 | 423 | 448 |

Test was very difficult with heavy loads of stains on cotton, 10 drops of spot remover on each spot, no rubbing, no regular detergent added, mini load with other clothes, cold water, short cycle. in this test the popular detergent was used as a spot remover.

Test was very difficult with heavy loads of stains on cotton, 10 drops of spot remover on each spot, no rubbing, no regular detergent added, mini load with other clothes, cold water, short cycle. In this test the popular detergent was used as a spot remover.

| Example Test 2[b] (%) | | | |
|---|---|---|---|
| Stain Type | Consumer Spot Remover #3 | Consumer Spot Remover #4 | Inventive Spot Remover |
| Ball point pen | 20 | 30 | 50 |
| Spaghetti | 80 | 85 | 90 |
| Spinach-pear baby food | 98 | 99 | 99 |
| Auto grease | 50 | 60 | 70 |
| Chocolate | 99 | 99 | 99 |
| Kitchen grease | 50 | 50 | 60 |
| Red wine | 95 | 70 | 60 |
| Coffee | 90 | 95 | 85 |
| Mustard | 80 | 75 | 85 |
| TOTAL REMOVAL | 662 | 663 | 698 |

[b]Test was very difficult with heavy loads of stains on cotton, 5 drops of spot remover on each spot, no rubbing, no regular detergent added, mini load with other clothes, cold water, short cycle.

While the apparatus, system, and method have been described with reference to various embodiments, those skilled in the art will understand that various changes may be made and equivalents may be substituted for elements thereof without departing from the scope and essence of the disclosure. In addition, many modifications may be made to adapt a particular situation or material in accordance with the teachings of the disclosure without departing from the essential scope thereof. Therefore, it is intended that the disclosure not be limited to the particular embodiments disclosed, but that the disclosure will include all embodiments falling within the scope of the appended claims. In this application all units are in the metric system and all amounts and percentages are by weight, unless otherwise expressly indicated. Also, all citations referred herein are expressly incorporated herein by reference.

The invention claimed is:

1. A cleaning formulation, comprising by weight:

about 23% coco alkyl ethoxylated amine, about 23% $C_{9-11}$ ethoxylated alcohol, about 5% d-limonene, about 6% hexylene glycol,
about 7% ether sulfate,
about 1% acrylate-styrene polymer,
optional dyes and perfumes, and
the remainder water.

2. The cleaning formulation of claim 1, containing dyes and perfumes.

3. The cleaning formulation of claim 1, wherein the formulation is used as a spot or stain remover for pre-treatment of laundry.

4. The cleaning formulation of claim 1, wherein the formulation is used as a laundry detergent.

5. The cleaning formulation of claim 1, wherein the formulation is used as a carpet cleaner.

6. The cleaning formulation of claim 1, wherein the formulation is used as a hard surface cleaner.

* * * * *